US006264762B1

(12) United States Patent
Bommer et al.

(10) Patent No.: US 6,264,762 B1
(45) Date of Patent: Jul. 24, 2001

(54) CORROSION RESISTANT MAGNESIUM COMPOSITIONS AND APPLICATIONS THEREOF

(75) Inventors: Heike Bommer, Wörth; Jürgen Lang, Backnang; Felix Nitschke, Munich, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 08/934,597

(22) Filed: Sep. 22, 1997

(30) Foreign Application Priority Data

Sep. 21, 1996 (DE) ..... 196 38 764

(51) Int. Cl.[7] ..... C22C 23/00

(52) U.S. Cl. ..... 148/420; 148/666; 148/667; 420/411; 420/412; 420/413

(58) Field of Search ..... 420/411, 412, 420/413; 148/420, 666, 667

(56) References Cited

U.S. PATENT DOCUMENTS

| | | | | |
|---|---|---|---|---|
| 1,992,655 | | 2/1935 | Fischer | 75/1 |
| 2,270,193 | | 1/1942 | McDonald | 75/168 |
| 3,947,268 | * | 3/1976 | Tikhonova et al. | 420/413 |
| 4,194,908 | * | 3/1980 | Unsworth et al. | 75/168 |
| 4,332,864 | | 6/1982 | King et al. | 429/3 |
| 5,342,576 | * | 8/1994 | Whitehead | 420/413 |

FOREIGN PATENT DOCUMENTS

| | | | |
|---|---|---|---|
| 679 156 | | 7/1939 | (DE) . |
| 1 939 794 | | 5/1972 | (DE) . |
| 1433108 | * | 8/1993 | (DE) . |
| 923066 | | 4/1963 | (GB) . |
| 1251223 | * | 10/1971 | (GB) . |
| 1601118 | | 10/1981 | (GB) . |
| 62-218527 | * | 9/1987 | (JP) . |
| 6256883 | * | 9/1994 | (JP) . |
| 8020835 | * | 1/1996 | (JP) . |
| 461963 | * | 2/1975 | (SU) . |
| 1770431 | * | 10/1992 | (SU) . |
| 9315238 | * | 8/1993 | (WO) . |

* cited by examiner

*Primary Examiner*—Sikyin Ip
(74) *Attorney, Agent, or Firm*—Evenson, McKeown, Edwards & Lenahan, P.L.L.C.

(57) ABSTRACT

A magnesium alloy material includes magnesium; more than 1 wt. % manganese; and at least one sp-metal selected from the group consisting of zinc, cadmium, mercury, gallium, indium, thallium, germanium, tin, lead, arsenic, antimony, and bismuth, wherein the manganese and the at least one sp-metal together are a maximum of 5 wt. % of the alloy material. The magnesium materials are resistant to corrosion and are especially useful in articles exposed to aqueous electrolytes during use or production.

18 Claims, No Drawings

CORROSION RESISTANT MAGNESIUM COMPOSITIONS AND APPLICATIONS THEREOF

BACKGROUND AND SUMMARY OF THE INVENTION

This application claims priority of German Patent Application 196 38 764.7, filed Sep. 21, 1996, the entire contents of which are incorporated herein by reference and can be relied on to practice the claimed invention.

Materials containing magnesium are important for lightweight construction in a number of fields. For example, lightweight magnesium compositions are employed in a variety of parts in the automobile industry, in engine construction technology, in aerospace technology, and in other structural, lightweight objects in the computer industry and the domestic appliance industry. The low specific weight of magnesium and its good strength characteristics allow a considerable weight reduction in components in comparison to parts made of aluminum or steel. The better pourability of magnesium alloys, in comparison to materials made of aluminum, also results in a reduction in processing steps and an increase in productivity. And, in contrast to materials made of aluminum, complicated, thin-walled parts can be made in large numbers by casting. Using materials made of magnesium in transport means also opens up a potential for lowering costs, saving fuel, and increasing payload.

The energy required for the primary production of magnesium competes with the price of primary production of aluminum. When magnesium is recycled, only 5% of the recovered energy is required to recycle it. This represents an improved overall energy balance for recycling materials made of magnesium by comparison to those made of aluminum. However, even if no recycling is performed, materials made of magnesium can readily be returned to the resource cycle in nature.

Today only a few percent of lightweight construction applications are made from magnesium alloys. Therefore, the use of magnesium compositions with the highest specific strength and the highest specific modulus of elasticity offers a high potential for increasing production economy and reducing environmental impacts.

However, an obstacle to using alloys made of magnesium is their corrosion behavior. Corrosion media that contains water can considerably affect the function of magnesium parts. In order to improve the corrosion resistance of magnesium parts, it is known to give them so-called conversion layers, especially conversion layers in which chromate (VI) ions are embedded in the surface of the part. Magnesium parts are also anodized. Both conversion layers and the anodization of parts, however, merely result in the passivity of the surface. This means that if the passivated surface layer is damaged, the corrosion protection fails at the damaged point.

The addition of cathodic impurities into materials made of magnesium can never be avoided completely. The quantity of cathodic precipitates has been reduced to a minimum since the development of highly pure magnesium alloys, but because of the manufacturing process, these precipitates are frequently present on the surface.

A goal of the invention is to provide a magnesium composition and/or material that has a high level of corrosion resistance in aqueous electrolytes. This is accomplished according to the invention with a magnesium composition or material that contains at least one of the elements from the group composed of sp-metals and manganese. The term "sp metals" refers to those metals whose outer s- or p-states of electron configuration are not filled.

In particular, the sp-metals consist of Zn, Cd, Hg, Ga, In, Tl, Ge, Sn, Pb, As, Sb, and Bi. The sp metals and/or manganese together account for a maximum of 5 wt. of the magnesium composition or material. Preferably, however, the content of these metal elements is only 0.1 to 2 wt., and especially 0.2 to 1 wt., since at higher concentrations intermetallic bonds can develop, which, as will be explained below, do not possess any corrosion-resisting properties, or in any event have reduced corrosion resisting properties.

The invention comprises, more specifically, a magnesium material characterized by a content of up to 5% by weight of at least one element from the group of sp-metals and manganese. Preferably, the content of the at least one element amounts to from 0.1 to 1% by weight. As noted, the sp-metal can be zinc, cadmium, mercury, gallium, indium, thallium, germanium, tin, lead, arsenic, antimony or bismuth, or a combination of metals.

Generally, the magnesium material is characterized in that the at least one element has an exchange current density for hydrogen reduction of no more than $10^{-7}$ A/m$^2$. Also, the magnesium material generally contains the sp-metal and/or manganese element(s) without the formation of intermetallic bonds or compounds, or substantially without intermetallic bonds or compounds. The invention also comprises the use of a magnesium material in a component that is exposed to aqueous electrolytes and methods for making corrosion-resistant parts.

DETAILED DESCRIPTION OF THE INVENTION

In general, magnesium materials can be pure magnesium metal or a magnesium alloy, especially a commercially available magnesium alloy.

The corrosion of magnesium metal in an aqueous medium proceeds according to the following reaction equations:

$$Mg \rightarrow Mg^2 + 2e^- \quad (1)$$

$$H^+ + e^- \rightarrow H_{at} \quad (2a)$$

$$H_{at} \rightarrow H_{ad} \quad (2b)$$

Reaction (1) represents anodic oxidation while the reaction equations (2a) and (2b) are the reduction reaction or adsorption reaction according to Volmer. This means that according to ($H_{at}$) and these are then adsorbed ($H_{ad}$). The recombination of two $H_{ad}$to molecular hydrogen proceeds according to the so-called Tafel or Heyrowsky reaction.

During the corrosion of magnesium parts, the reduction reaction proceeds especially at those points where, for example, a less negative potential is present as a result, for example, of cathodic impurities in a magnesium alloy. These cathodic impurities can be present as more noble metals, copper, iron, or nickel, for example, or a higher aluminum content. At these cathodic points on the part, partial reactions (2a) and (2b), hydrogen development, takes place.

The elements used in the compositions and materials according to this invention are characterized in that they result in a high hydrogen overpotential, in other words they inhibit both hydrogen reduction (2a) and hydrogen adsorption (2b). By virtue of their homogeneous distribution in the mixed crystal, these elements influence the electron configuration of the matrix and poison, so to speak, the development of hydrogen so that the anodic oxidation of the magnesium according to equation (1) does not take place.

The high hydrogen overpotential of these elements expresses itself in a correspondingly low exchange flow density for hydrogen reduction and this exchange flow density for these metals is no more than $10_{-7}$ A/m$^2$.

The elements should be distributed as homogeneously as possible in the magnesium material of this invention. In no event may intermetallic bonds form from these elements since they have different properties, especially a different exchange current density for hydrogen reduction, and thus will not lead to the desired high hydrogen overpotential.

The formation of intermetallic bonds can be prevented by adding as little as possible of the alloy elements or by appropriate manufacturing methods for the magnesium material. For example, formation of intermetallic bonds can be prevented by using powder metallurgy methods, using magnesium or magnesium alloy powder, and an alloy element powder, or heat treatment with rapid cooling. Other methods are also known the art.

In addition to their intervention in partial reactions (2a) and (2b), the sp-metal or manganese elements act as anodes when the magnesium part, as a result of impurities, for example, contains locations with a less negative potential acting as cathodes.

When the sp-metals and manganese are oxidized as anodes, they form compounds that are difficult to dissolve, namely oxides and/or hydroxides. In addition, intermediate compounds such as chlorides can form first, which then are hydrolyzed in the alkaline marginal area of the surface of the part, especially at the cathodic reaction locations. As a result of their anodic oxidation to form the above mentioned compounds, the sp metals and/or manganese stop corrosion and cure the material.

As is apparent from the above to one skilled in the art, the magnesium compositions or material according to the invention are especially suitable for parts that are used in aqueous electrolytes. The corrosion-resistance effect of the sp metals or manganese is thus observed in both halide-containing and halide-free aqueous media, and also at elevated temperatures. Since the invention achieves a corrosion resistance independent of the state of the surface, a highly reliable magnesium-containing part results.

EXAMPLE

A magnesium alloy material containing 3% manganese was made as follows: Ninety-seven (97) parts by weight of ZC63 (a commercial magnesium alloy containing 6% Zn and 3% Cu) and 5.88 parts by weight of $MnCl_2$ are heated up to 700–720° C., in an inert gas atmosphere (argon with $SF_6$). The system is maintained at this temperature for 30 minutes for sedimentation and for reaction of $MnCl_2$ to Mn and $Cl_2$. The melt is filled in molds under pressure. A gooseneck is required for this process to separate the contaminations of a higher density, such as those containing iron. Then, the melt cools down to 100° C. in 90 seconds. Further cooling takes place under air at room temperature. The magnesium alloy contains 3% Mn. However, similar conditions can be used, as would be apparent to one skilled in the art from this disclosure, to produce magnesium alloys of up to 5 wt. % Mn, or in specific ranges, such as 0.1 to 2 wt. % or 0.1 to 1 wt. %.

Characterization of the Corrosion-resistant Properties of ZCp63+3% Mn Compared with Mg Pure and ZC63

The corrosion behavior of the Mg-materials were investigated with an alternate immersion test (ASTM-Standards G-44).

The conditions were as follows:

| | |
|---|---|
| Solution: | 3.5 mass-% NaCl, pH 7 |
| Volume of Solution: | 32 ml/cm$^3$ |
| Test-duration: | 4 h |
| Immersion duration: | 50 min |
| Relative Humidity: | 45% +/− 10% |
| Temperature: | 27° C. +/− 1° C. |

The presence or attachment of corrosion is estimated on transversal polishings with metallographic methods. The results are shown on the table below.

| Alloy | Maximal deep of pittings [μm] | number of pittings/cm |
|---|---|---|
| $Mg^+$ | 400 | 222 (total attack) |
| ZC63* | 220 | 46 |
| ZC63 + 3% Mn** | 30 | 30 |

*comparison
**invention

Dramatic reductions in the depth of pitting and in the number of pittings, a measure of the progress and occurrence of corrosion, can be seen with the composition of the invention when compared to prior compositions.

Although the invention has been described and illustrated in detail, it is to be clearly understood that the same is by way of illustration and example, and is not to be taken as a limitation. The spirit and scope of the present invention are to be limited only by the terms of the appended claims.

What is claimed is:

1. A magnesium alloy material, consisting of:

magnesium;

more than 2 wt. % manganese; and a corrosion-resisting amount of at least one sp-metal selected from the group consisting of cadmium, mercury, indium, thallium, germanium, tin, lead, arsenic, antimony, and bismuth, wherein the manganese and the at least one sp-metal together are a maximum of 5 wt. % of the alloy material.

2. A magnesium alloy material according to claim 1, comprising from 0.1 to 2 wt. % of the at least one sp-metal.

3. A magnesium alloy material according to claim 1, comprising from 0.1 to 1 wt. % of the at least one sp-metal.

4. A magnesium alloy material according to claim 1, wherein at least one of manganese and the sp-metal has an exchange current density for hydrogen reduction of no more than $10^{-7}$ A/m$^2$.

5. A magnesium alloy material according to claim 2, wherein at least one of manganese and the sp-metal has an exchange current density for hydrogen reduction of no more than $10^{-7}$ A/m$^2$.

6. A magnesium alloy material according to claim 3, wherein at least one of manganese and the sp-metal has an exchange current density for hydrogen reduction of no more than $10^{-7}$ A/m$^2$.

7. A magnesium alloy material according to claim 1, wherein there are no or substantially no intermetallic bonds.

8. A magnesium alloy material according to claim 2, wherein there are no or substantially no intermetallic bonds.

9. A magnesium alloy material according to claim 3, wherein there are no or substantially no intermetallic bonds.

10. An article of manufacture, which comprises a component comprising a magnesium alloy material according to claim 1.

11. An article of manufacture, which comprises a component comprising a magnesium alloy material according to claim 2.

12. An article of manufacture, which comprises a component comprising a magnesium alloy material according to claim 3.

13. A method of making a metallic part resistant to corrosion upon exposure to aqueous electrolytes comprising producing said part from a magnesium alloy material according to claim 1.

14. A method of making a metallic part resistant to corrosion upon exposure to aqueous electrolytes comprising producing said part from a magnesium alloy material according to claim 2.

15. A method of making a metallic part resistant to corrosion upon exposure to aqueous electrolytes comprising producing said part from a magnesium alloy material according to claim 3.

16. A magnesium alloy material according to claim 1, wherein the at least one sp-metal is tin.

17. A magnesium alloy material according to claim 1, wherein the at least one sp-metal is indium.

18. A magnesium alloy material, consisting of:

magnesium;

more than 1 wt. % manganese; and at least one of tin, arsenic, or antimony, wherein the manganese and the at least one of tin, arsenic, or antimony are a maximum of 5 wt. % of the alloy material.

* * * * *